US007893338B2

(12) United States Patent
Chew

(10) Patent No.: US 7,893,338 B2
(45) Date of Patent: Feb. 22, 2011

(54) METHOD OF COMPOSING MUSIC ON A HANDHELD DEVICE

(75) Inventor: Seok Kwee Chew, Milpitas, CA (US)

(73) Assignee: Creative Technology Ltd, Singapore (SG)

( * ) Notice: Subject to any disclaimer, the term of this patent is extended or adjusted under 35 U.S.C. 154(b) by 620 days.

(21) Appl. No.: 10/892,630

(22) Filed: Jul. 15, 2004

(65) Prior Publication Data

US 2006/0011044 A1 Jan. 19, 2006

(51) Int. Cl.
*A63H 5/00* (2006.01)
*G04B 13/00* (2006.01)
*G10H 7/00* (2006.01)

(52) U.S. Cl. ..... 84/609

(58) Field of Classification Search ..... 84/609, 84/645

See application file for complete search history.

(56) References Cited

U.S. PATENT DOCUMENTS

| | | | | |
|---|---|---|---|---|
| 4,491,049 | A * | 1/1985 | Mizuta et al. | 84/609 |
| 6,018,654 | A * | 1/2000 | Valentine et al. | 455/414.4 |
| 6,094,587 | A * | 7/2000 | Armanto et al. | 455/567 |
| 6,366,791 | B1 * | 4/2002 | Lin et al. | 455/567 |
| 6,414,229 | B1 * | 7/2002 | Gaudet | 84/465 |
| 2003/0013497 | A1 * | 1/2003 | Yamaki et al. | 455/567 |
| 2003/0079598 | A1 * | 5/2003 | Nakayama | 84/609 |

OTHER PUBLICATIONS

Author Unknown, "Nokia Connecting People", *Nokia 3390 User Guide*, Fun and Games pp. 105-110.

Author Unknown, "What Is Numbered Musical Notation", *Magith*, Commuent Software, http://www.2bhonest.com/notation.htm, pp. 1-7 (2002-2004).

Author Unknown, "It's So Easy To Create Music! ", *Magith* (Polyphonic Ringtone Composer (SP-MIKI, SMAF, RTTTL, iMelody Converter), Commuent Software, http://www.2bhonest.com/notation.htm, pp. 1-2 (2002-2003).

Author Unknown, "It's So Easy To Create Music!", *Magith* (Magith Screen Shots), Commuent Software, http://www.2bhonest.com/shots.htm, pp. 1-2 (2002-2003).

Author Unknown, "HandPhones.info—Mobile Phone Articles—Nokia Composer Format", HandPhones.info, http://www.handphones.info/articles/nokia_composer_format.php, pp. 1, (2001-2004).

Author Unknown, "S-Music Alpha Version—An Editor For Simplified Music Notation—Free Software", *A1 Soft*: (A1 Soft Simplified Music Notation Editor, Free Software), http://www.a1soft.com/smusic.htm, pp. 1-2 (1999).

Author Unknown, "Nokia 5210 User's Guide", *Nokia Corporation* (Electronic User's Guide Released Subject to Nokia User's Guides Terms and Conditions), pp. 68-69 (1998).

* cited by examiner

*Primary Examiner*—Jeffrey Donels

(57) ABSTRACT

A musical sequence is formed on the keypad of a handheld electronic device. The numbered keys on the keypad of the handheld device are mapped directly to corresponding notes in an octave. The sequence of musical notes is entered by depressing at least one numbered key on the keypad and displaying a numerical representation of the sequence on the display screen of the handheld device.

20 Claims, 7 Drawing Sheets

| Half-step | 1 | 2 | 3 | 4 | 5 | 6 | 7 | 8 | 9 | 10 | 11 | 12 |
|---|---|---|---|---|---|---|---|---|---|---|---|---|
| KEY | C | C# | D | D# | E | F | F# | G | G# | A | A# | B |
| C | 1 | | 2 | | 3 | 4 | | 5 | | 6 | | 7 |
| D | | 7 | 1 | | 2 | | 3 | 4 | | 5 | | 6 |
| E | | 6 | | 7 | 1 | | 2 | | 3 | 4 | | 5 |
| F | 5 | | 6 | | 7 | 1 | | 2 | | 3 | 4 | |
| G | 4 | | 5 | | 6 | | 7 | 1 | | 2 | | 3 |
| A | | 3 | 4 | | 5 | | 6 | | 7 | 1 | | 2 |
| B | | 2 | | 3 | 4 | | 5 | | 6 | | 7 | 1 |

MAPPING FOR KEY REFERENCE C=1

| WESTERN | C | D | E | F | G | A | B |
|---|---|---|---|---|---|---|---|
| NUMERIC | 1 | 2 | 3 | 4 | 5 | 6 | 7 |

MAPPING FOR KEY REFERENCE E=1

| WESTERN | E | F# | G# | A | B | C# | D# |
|---|---|---|---|---|---|---|---|
| NUMERIC | 1 | 2 | 3 | 4 | 5 | 6 | 7 |

| | C | C# | D | D# | E | F | F# | G | G# | A | A# | B | C | C # | D | D# | E |
|---|---|---|---|---|---|---|---|---|---|---|---|---|---|---|---|---|---|
| C major | 1 | | 2 | | 3 | 4 | | 5 | | 6 | | 7 | 1' | | 2' | | 3' |
| D major | | | 1 | | 2 | | 3 | 4 | | 5 | | 6 | | 7 | 1' | | 2' |
| E major | | | | | 1 | | 2 | | 3 | 4 | | 5 | | 6 | | 7 | 1' |

*Fig._2D*

| | C | C# | D | D# | E | F | F# | G | G# | A | A# | B | C | C# | D | D# | E |
|---|---|---|---|---|---|---|---|---|---|---|---|---|---|---|---|---|---|
| C major | 1 | 1# | 2 | 2# | 3 | 4 | 4# | 5 | 5# | 6 | 6# | 7 | 1' | 1'# | 2' | 2'# | 3' |
| D major | | | 1 | 1# | 2 | 2# | 3 | 4 | 4# | 5 | 5# | 6 | 6# | 7 | 1' | 1'# | 2' |
| E major | | | | | 1 | 1# | 2 | 2# | 3 | 4 | 4# | 5 | 5# | 6 | 6# | 7 | 1' |

*Fig._2E*

| Western | Numeric | Handheld |
|---|---|---|
| Quarter note | X | X |
| Half note | X- | X- |
| Whole note | X--- | X--- |
| Eighth note | X | X/ |
| Sixteenth note | X<br>= | X// |
| 32nd note | X<br>≡ | X/// |
| Dotted note | X• | X. |
| Octave higher | •<br>X | X' |
| Octave lower | X<br>• | X, |
| 1/8 rest | 0 | 0/ |
| ¼ rest | 0 | 0 |
| Whole rest | 0000 | 0000 |

*Fig._2F*

METHOD OF COMPOSING MUSIC ON A HANDHELD DEVICE

BACKGROUND OF THE INVENTION

1. Field of the Invention

The present invention relates to methods for composing music. More particularly, the present invention relates to the use of keypads on handheld devices for the composition of music.

2. Description of the Related Art

The wireless telephone market has grown rapidly in the past decade. Recent trends have focussed on the miniaturization of the wireless telephone concurrently with the expansion of the phone's capabilities. The wireless telephones typically come equipped with a processor and memory for managing not only the transmission and reception of telephone calls but also for the execution of a variety of software applications resident on the wireless handheld. For example, typical applications have included calendars, address books, and entertainment games. In some cases, the wireless user is able to customize the phone, including the configuration of the handheld display and the distinct telephone rings associated with the receipt of an incoming telephone call.

As the number of wireless telephone devices increase, so too is the desire to differentiate an individual's phone from others. For example, in a crowded room, it is often desirable to be able to differentiate a particular user's phone ring from that of others. To meet these and other objectives, wireless phone manufacturers and providers often provide ringtone options for consumers. That is, the ringing of the phone, i.e., the ringtones, may be customized for the particular user.

Generally, ringtones may be implemented on a wireless device in one or more of several methods. In particular, a ringtone sequence may be created by a software application on a host computer and transferred in a suitable format to the wireless device, for example through an infrared port or a direct electrical connection, such as through a USB port on the host computer. Unfortunately, this method requires a separate host computer to compose the sequence and is further limited in requiring hardware to transfer the completed sequence to the wireless phone device, thus preventing the wireless user from spontaneously composing a ringtone or other musical composition when separated from the host computer.

Ringtones are also available for downloading from the internet or from the cellular phone provider. In the first instance, a host computer is again typically required for receipt of the download, followed by a separate transfer step from the host computer to the wireless device. In the second instance, the number of available ringtones is typically limited. Unfortunately, neither instance offers the wireless user the creative latitude to create an original musical sequence, i.e., to compose music.

Another available method involves the manual creation of the ringtone sequence by the user by keying in manually the ringtone sequence. In the manual keying method, the user typically uses the wireless telephone keypad (i.e., the handset) to enter a sequence of keystrokes. While this method does permit musical composition directly from the keypad of the wireless device, the input sequence and display notations require significant user training. That is, the current methods for generating ringtone sequences on handsets are rather cumbersome. For example, for each note, a sequence of codes involving letters, numbers and symbols is typically required. This is not an intuitive step and interferes with the creative process. Further, considerable effort is required to decipher the displayed sequence, again interfering with the creative musical composition efforts.

Accordingly, what is needed is an easy to learn method for keypad musical composition that generates an equally easy to comprehend display of the entered sequence.

SUMMARY OF THE INVENTION

To achieve the foregoing, the present invention provides a method for entering a musical sequence using a keypad of a handheld electronic device. A musical sequence is formed on the keypad of a handheld device. The numbered keys on the keypad of the handheld device are mapped to corresponding notes in an octave. The sequence of musical notes is entered by depressing at least one numbered key on the keypad and displaying a numerical representation of the sequence on the display screen of the handheld device.

According to one embodiment, the method for forming a musical sequence on a handheld device includes entering a sequence of musical notes by depressing at least one numbered key on the keypad of the handheld device. The keypad includes a plurality of keys mapped to corresponding notes in at least one octave. The numbered key selected for each note corresponds to the mapping of the notes in the musical sequence. The numerical representation of the musical sequence is displayed on the display screen of the handheld device.

According to another embodiment, the mapping between the numbered keys on the keypad and the notes of the octave are represented by the numbered keys 1 to 7 to correspond to a diatonic scale for an octave. Each progressively higher note in the diatonic scale for the octave corresponds to a progressively higher numbered key on the keypad.

According to yet another embodiment, after the musical sequence is formed, the sequence of musical notes is converted to one of a standardized format.

These and other features and advantages of the present invention are described below with reference to the drawings.

BRIEF DESCRIPTION OF THE DRAWINGS

FIGS. 2D-2E are tables illustrating conversion from conventional Western staff notation to numeric notation in accordance with one embodiment of the present invention.

FIG. 2F is a diagram illustrating conversion of duration and other parameters from a conventional Western staff notation format to a numbered keypad format in accordance with one embodiment of the present invention.

DETAILED DESCRIPTION OF PREFERRED EMBODIMENTS

Figure 1A:
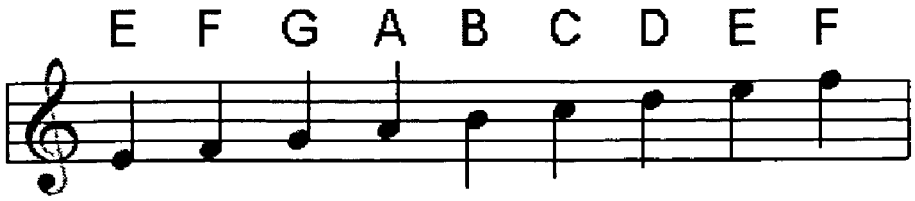
Fig. 1A (Prior Art)
FIG. 1A is a diagram illustrating a conventional Western staff notation format.

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known process operations have not been described in detail in order not to unnecessarily obscure the present invention.

A musical sequence is formed on the keypad of a handheld wireless telephone. The numbered keys on the keypad of the handheld wireless device are mapped directly to a corresponding sequence of notes in a diatonic scale of an octave. The sequence of musical notes is entered by depressing at least one numbered key on the keypad and displaying a numerical representation of the sequence on the display screen of the handheld device.

Musical notation is responsible for representing musical tones, and their modifications, by means of written characters. The present invention provides an efficient method for composing music on the keypad of a handheld electronic device by using a music notation system employing features of the numeric musical notation system in lieu of the Western staff notation system or other systems. The Western staff notation, also known as sheet music notation, enjoys wide acceptance throughout the world, particularly in Europe and the United States. It relies on a printed staff, typically designated with a treble or bass clef, with various notes and other symbols printed on the staff. Unfortunately, due to its reliance on a graphical display, the Western staff system does not lend itself easily to composing ringtones or other music on a handheld device. The present invention provides a method of composing music on a handheld device using a music notation system that is capable of representing most if not all of the parameters represented by the Western staff system, but in an easily understood and transmittable numeric musical format.

Two of the most important parameters represented in the music notation system used in the present invention include pitch and duration. The Western staff notation is described herein for comparison purposes, since its use is widespread and generally known to skilled musicians and composers. In the Western staff system, the pitch is defined by the positioning of notes on a staff. A staff is generally defined as five parallel, equidistant lines with spaces in between. Clefs are symbols used at the start of a piece to designate the location of the staff within the frequency space. For example, the treble or "G" clef designates a staff located above middle "C" (i.e., the note with a frequency of about 261 hz). In contrast, the bass or "F" clef designates the staff below middle "C". In this way, the Western staff notation provides a graphical representation of the various pitches required in the musical sequence.

Independent of the notation system used, the octave has particular importance in music as does the diatonic scale for the octave. In music, an octave is the interval between one musical note and another whose pitch is twice its frequency. In the Western staff system, notes an octave apart are given the same note designation. Thus, every C note is one octave apart from an adjoining C and the two notes have a frequency ratio of 2:1.

In contrast to the graphical presentation of the Western staff system, various embodiments of the present invention use a text based numbered music notation system. The pitch of the note is generally defined by the mapping of the notes for a diatonic scale for an octave onto numbered keys on the keypad of the handheld, preferably the keys 1-7. In order to understand the basis for mapping an octave onto seven numbered keys representing 7 degrees of the octave, further discussion of the chromatic scale and the diatonic scale for an octave is provided.

The chromatic scale is a musical scale that divides an octave into subdivisions of twelve pitches. In other words is, a selected note will be followed by 11 notes in the octave before the note an octave above the first note is reached. Each pitch is separated from the adjacent pitches in the chromatic scale by one half step, or semitone. Each of the intermediate frequencies in sequence for the octave represents an increment of approximately 6% relative to the preceding intermediate frequency.

The diatonic scale, as a subset of the chromatic scale, represents an octave of pitches by seven notes or degrees. These degrees are selected to provide a particular consonance to a musical composition. The seven degrees of the octave represent progressively higher frequencies in proceeding from the selected note to the octave of the note, i.e., the note having a frequency or pitch twice that of the selected note.

For the Western staff system, these scale degrees are designated by the letters A through G with selected accidentals (i.e., sharps or flats) added to selected of the letters to cover all of the 12 pitches (in the chromatic scale). A sharp represents a half step increase in pitch whereas a flat indicates a half step decrease. In contrast, the numbered or numeric notation system, as used in embodiments of the present invention, assigns the numbers 1 to 7 to the diatonic scale degrees and assigns the corresponding numbered keys on the keypad to these scale degrees.

In the Western staff system, clefs are symbols used at the start of a piece to designate the location of the staff within the frequency space. For example, the treble or "G" clef designates a staff located above middle "C" (i.e., the note with a frequency of about 261 hz). In contrast, the bass or "F" clef designates the staff below middle "C". In this way, the Western staff notation provides a graphical representation of the various pitches required in the musical sequence.

Although the Western system is widely used, the letters assigned to notes are not identifiable in an intuitive manner, i.e., they are not readily understood by novices to music. For example, the lines for the treble clef designate the following notes, in order from the bottom up: E, G, B, D, F. The spaces designate the notes F, A, C, E, in order from the bottom up. In contrast, the "F" clef uses different note designations for the lines and spaces. That is, the lines are labeled G, B, D, F, A and the spaces are designated A, C, E G. Unfortunately, a great deal of training is required to memorize and learn the note identifications and their corresponding positions on the staff. Mnemonics such as "All Cows Eat Grass" (for the "F" clef) and "Every Good Boy Does Fine" (for the "G" clef) have been used to aid with the memorization of the note locations on the corresponding staffs.

Figure 1B:
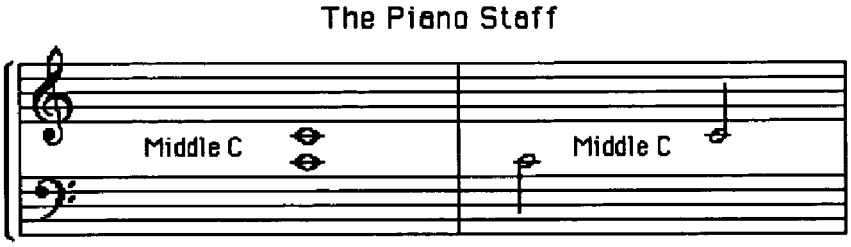
Fig. 1B (Prior Art)
FIG. 1B is a diagram illustrating a grand staff used in conventional Western staff notation format.

To further appreciate the difficulties presented by the use of the Western staff system and attempts to adapt it to handheld devices, examples of musical sequences in the conventional Western system are illustrated and described below. FIG. 1A illustrates an example of a conventional Western staff notation. In particular, nine different pitches are represented by the sequence of notes (designated by the letters). The pitches of the individual notes are determined by their locations on the staff, and the designation of the staff (here with a treble or G clef). FIG. 1B illustrates a piano staff or grand staff, which is a combination of both a treble and a bass clef (staff). The bass staff represents a sequence of notes lower than the lowest note illustrated by the treble staff. As can be appreciated, though this musical notation system is widely employed, it requires a great deal of training to recognize the individual note locations and their corresponding pitches, especially when the nuances of Western music are represented. Moreover, its reliance on a graphical display makes it difficult to present on the small display screens usually found on handheld electronic devices, such as wireless phones. In contrast, in the various embodiments of the present invention, the numbers 1 through 7 are entered on the keypad to correspond to the respective scale degrees of the corresponding diatonic scale.

Because the Western staff system uses a fixed correspondence between a note and its pitch, key transposition is difficult. In other words, a particular note placed on a staff designated by a particular clef will always have a predetermined pitch. To change keys, the note or staff must be changed or other symbols (e.g., accidentals) must be added. This complicates the graphical representation of the music sequence.

Figures 1C, 2A, 2B, 2C:
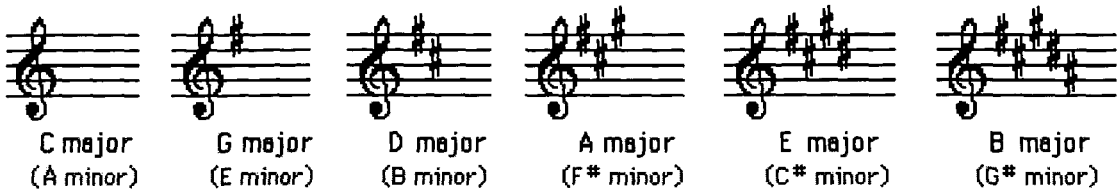
Fig. 1C (Prior Art)
FIG. 1C is a diagram illustrating key signatures in accordance with conventional Western staff notation.
FIG. 2A is a table illustrating various key designations in the Western format.
FIGS. 2B-2C are tables illustrating conversion from conventional Western staff notation to numeric notation in accordance with one embodiment of the present invention.

To elaborate, each diatonic scale is usually referred to by the root note or tonic note, i.e., the first note in the ascending sequence of 7 notes in the octave. The major key scales will always have semitone jumps of 2-2-1-2-2-2-1 to traverse the 12 semitone intervals for the scale between a note and its octave while a Minor scale has semitone jumps of 2-1-2-2-1-2-2, each of the "2's" on the preceding sequence referring to a tone interval (whole step). For example, in the C major scale, which is a scale commonly used for composition, letters (without accidentals) can represent each of the steps in the scale. But, as illustrated in FIG. 2A, for a number of the other major scales, the seven degrees in the diatonic scale include several of the letters modified by accidentals (i.e., sharps or flats). For a specific example, the G major scale's seven scale degrees are represented by the sequence G-A-B-C-D-E-F#-G. Thus, a musical composition written in the key of G will contain mostly F #'s instead of F naturals.

The Western staff system accommodates changes in key by using a key signature. This is denoted by the collection of accidentals placed after the clef sign, as further illustrated in FIG. 1C. In specific, FIG. 1C illustrates the designation of various keys. For example, in order to dictate playback of the composition in the G major key, the "sharp" accidental placed on the $5^{th}$ line of the staff indicates that throughout the score the notes appearing on that line are "sharped", i.e., increased by a semitone. While this notation method works well enough for indicating the pitch of a note, it is unwieldy in permitting complete transposition of a musical sequence from one key to another. As noted above, the musical sequence according to the diatonic scale is defined by increments of 2-2-1-2-2-2-1 for the octave. Thus, to change from the C major scale to the to the D major scale, an example sequence of 4 notes would change from C-D-E-F to D-E-F#-G. This occurs because of the Western staff notation system's fixed correspondence between the note and its pitch.

The present invention overcomes these and other problems with the conventional Western music notation system by entering and displaying music in accordance with a numeric (or "numbered") musical notation system. The numeric (or "numbered") musical notation was first developed by Jean Jacques Rousseau in the eighteenth century and is well known in China. Instead of using the letters A through G to represent the pitch, the numbers 1 through 7 are used. Further, instead of assigning a fixed pitch to a letter, for example by assigning a pitch of 261 hz. to middle C, the numeric system adopted in embodiments of the present invention assigns or maps each number to a particular degree in the octave, i.e., in the diatonic scale used for the particular octave.

This system of mapping a numbered key to a degree in the diatonic scale also facilitates key transposition. Keys are important because they will affect the "mood" of the piece. Keys are also dependent on the range desired for the piece. For example, a musical composition designed for the range of a particular vocalist or instrument will sound best when the composition is noted in certain musical keys. For example, some people believe that the F major key is mellower than the C major key, which is generally thought to be brighter. In summary, transposing keys is commonly done to accommodate different music, different instruments, different vocal ranges, and generally to make music more interesting.

The embodiments of the present invention enable transposition to be easily performed. In specific, when a musical composition or ringtone composed according to the keypad numbered system is changed from one key to another, for example, from C to E, the numbers for the notes do not change. Changing of the key may be accomplished by changing a key designation in the header for the ringtone or other musical file. Editing is facilitated by a meaningful display showing the notes by the same numbers entered on the handheld keypad. As further illustrated by the exemplary embodiments described below, entry of a ringtone in accordance with the numeric system of the present invention is easily accomplished on a handheld electronic device.

FIG. 2A provides a table illustrating various musical key designations in the Western format. Inspection of the table reveals the difficulties found in transposing keys in the Western system. The top row of the table indicates each of the chromatic half-steps (or semitones) making up the chromatic scale with the second row indicating exemplary Western staff system note designations for the semitones. The numbers in each of the rows below the second indicate the sequence of note designations for diatonic scales in the major keys C, D, E, F, G, A, and B. As is known to skilled musicians, the first note in each of the major keys starts with the note designated by the key. That is, the first note (scale degree) in the C major scale starts with C in the Western system. By comparison, the same note in the numeric system is designated by a "1". Since the numeric system used in accordance with embodiments of the present invention assigns the numbers 1 to 7 to the scale degrees, this table also illustrates the mapping of a particular note (designated by a particular Western system letter) to a corresponding numeric system number, depending on the key selected. This mapping is shown in further detail in FIGS. 2B-2F.

In particular, FIGS. 2B-2F lists exemplary mappings of a sequence of musical notes, particularly with reference to the pitch parameter from the Western staff system as utilized in one embodiment of the present invention. For example, in the key of D major, the scale degrees for an octave proceed according to the sequence D-E-F#-G-A-B-C#, as shown in FIG. 2D. For the key of C major (i.e., the key reference=C), the scale degrees for an octave proceed according to the sequence C-D-E-F-G-A-B, as shown in FIG. 2B. As a further example, in the key of E major, the scale degrees for an octave proceed according to the sequence E-F#-G#-A-B-C#-D#, as further shown in FIG. 2C. In each case, the mapping of the degrees in the diatonic scale for the octave proceeds according to the sequence 1-2-3-4-5-6-7. That is, for each key, the Western staff notation designations of notes are mapped to the sequence 1-7 for the numbered notation system. In accordance with one preferred embodiment of the present invention, the entry of notes on the keypad of the handheld device proceeds with a default key of C. This corresponds well with the numeric system known in China, where by default the first note is assigned to middle C.

As a further example, FIG. 2D illustrates the mapping of C, D, and E major scales from the Western staff system to the keypad numbered system (for the diatonic scale) in accordance with the present invention. FIG. 2E illustrates a mapping of C, D, and E major scales from the Western staff system to the keypad numbered system for the seven degrees of the diatonic scale and includes accidentals. For example, an "E" note in the C major scale in the Western staff system maps to a "3" in the numeric system whereas an F# in the Western D major scale maps to a "3" in the numeric system of the various embodiments of the present invention. The "2'" designation refers to a note an octave higher than the "2", as will be described further with reference to FIG. 2F.

It is to be appreciated by those skilled in music that appending a corresponding flat to a higher note can also designate an equivalent to the sharp appended note. For example, a "C#" note is equivalent to a "Db" note. Thus, the present invention is intended to extend to the mapping of a note to a numeric note with a "flat" appended as an alternative to adding a sharp to a lower numeric note designation.

The numeric music notation depends on assigning numbers to octave diatonic scale degree designations rather than fixing a particular symbol to a particular pitch. Hence, those familiar with the numeric musical notation system will appreciate the ease with which key transposition is performed when entering or editing music in accordance with selected embodiments of the present invention. Rather than changing each letter and in some cases adding an accidental, the numbers in the numeric system do not change as the music is transposed from one key to another. The numeric system facilitates transformation between keys because the numbers used to represent the respective pitches correspond to the degrees of the scale. That is, the number 1 always refers to the first scale degree or increment. Thus, in the C major scale the sequence of 3 notes from the lowest in the octave is denoted as 1-2-3. Similarly, for the D major scale, the sequence of 3 notes is again denoted as 1-2-3. Hence, transformation from the C major key to the D major key or any other key is accomplished by only changing a "key reference" at the start of the musical sequence, i.e., the musical composition. This is especially important in the composition of music on portable devices, such as handheld wireless telephones. Rather than reentering a sequence of numbers and/or letters as required by current schemes to change keys, the method provided in the present invention permits transposition by a minimized number of key entries.

Musical compositions often involve more than one octave. Accordingly, in order to represent a higher or lower octave, the numeric musical notation system in graphical format places a single dot above the particular number representing the note, two dots to representing two octaves higher, one dot below the number for an octave lower, and two dots below the number to represent two octaves lower. Thus, a number with one dot above the number is two octaves higher than the same number with a single dot below the number. For entry on the keypad of a handheld device, preferably changing of the octave for a particular note is preferably accomplished by adding an apostrophe (') for an octave higher and a comma (,) for an octave lower, as illustrated in FIGS. 2B-2F.

Another important parameter represented by Western staff (i.e., sheet music) notation is the duration of the notes. The Western staff system uses a system of hollow and filled in notes along with stems, flags, ties, and dots to indicate duration. A whole note is the simplest and is depicted without stems or flags. A note that lasts half as long as a whole note is a half note. A note that lasts a quarter as long as a whole note is a quarter note and is represented by the half note symbol filled in. The pattern continues with eighth notes, sixteenth notes, thirty-second notes, sixty-fourth notes, and so on, each type of note being half the length of the previous type.

In contrast, the known numerical notation system upon which various embodiments of the present invention are based uses instead a system of underscores (to indicate halving of the notes' values) and dots (.) to indicate the equivalent of a Western staff dotted note. That is, adding a dot to a quarter note increases its value by 50%. The keypad numbered notation system employed in embodiments of the present invention modifies these representation for the text based displays by using "slashes" instead of underscores and a dot (.) placed adjacent to the numbers representing the pitch parameters. Dashes are used to indicate lengthening of the note. Thus, a number (equivalent, for example, to a quarter note) followed by a dash is equivalent to a half note. A number followed by two dashes is equivalent to three-quarter notes. According to a preferred embodiment of the present invention, a slash is used to indicate shortening of the note. The presently identified embodiment also uses the rest notation adopted by the numeric system. That is, a "0" indicates a rest. An extended rest period is preferably represented by multiple zeroes. For example, a "whole" rest may be indicated by a sequence of 4 consecutive "0's". An eight rest may be indicated by a "0" followed by a slash (/).

These parameters are further listed in FIG. 2F, which is an exemplary mapping of a sequence of musical notes, particularly with reference to the duration parameter from the Western scale as utilized in one embodiment of the present invention. For reference purposes, the symbol "X" as listed in FIG. 2F, is intended to refer to any of the numeric keys corresponding to the pitch. In other words, in a default C major scale, entering and displaying "3-" would designate a half note duration for the pitch corresponding to "E". The "numeric" column in FIG. 2F corresponds to the numbered musical notation system format developed by Rousseau and familiar to many. The handheld column refers to the format appropriate for entry on a keypad of a handheld, i.e., the numbered system as modified for entry and display on a handheld according to embodiments of the present invention.

According to a preferred embodiment, the entry of the pitch and duration parameters on the keypad of the handheld device are selected to correspond closely to the graphical designations for the known numeric system. However, the particular symbols used for entry and display are intended to be illustrative and not limiting. That is, the scope of the present invention is intended to extend to the use of other symbols for lengthening, shortening, and octave changes in conjunction with the described numeric key entry and display to meet the particular limitations of a handheld device and its display.

In a preferred embodiment, the present invention provides a method for entering and editing a musical sequence as based on the numeric musical notation system. The entry, presentation and editing capabilities of the various embodiments of the present invention provide distinct advantages over the conventional Western system. Although the Western staff notation system enjoys significant popularity, it is not readily adaptable to either entering or displaying musical sequences on handheld electronic devices having small display screens. For example, some wireless (mobile) telephones are capable only of displaying three or less text lines. Hence, the display of graphical figures including a full Western staff covered with musical notes and other symbols are beyond the capabilities of such displays. Even where advanced displays on handheld devices are capable of displaying a full staff and notes, entering such notes would require the composer (user) to mentally translate the desired notes to a corresponding keypad alpha or numeric key. In contrast, the numeric music notation system is better suited for both entering and display on a keypad of a handheld electronic device by permitting the direct entry of the number with the subsequent display of the number providing a meaningful representation of a pitch parameter.

While the description has been directed to entering musical sequences on wireless handheld phones, these examples should be considered as illustrative and not limiting. That is, the scope of the present invention is intended to extend to any electronic device having keypads for entry of numbers and storage means or transmission means. The scope is intended to extend to any and all handheld electronic devices, including as a non-limiting example personal digital assistants ("PDA's") or handheld computers. For example, hand-held or palm sized computers having keyboard or stylus/touch-screen technology may be adapted to enter musical sequences in accordance with the techniques described herein. Touch-screen data entry methods, for example, often include the presentation of a keyboard on the screen and respond to the touching of the screen by a stylus as if "hard" keys were depressed. Hence, the scope of the invention is intended to include entering of musical sequences using alternate forms of key entry such as touch screen or other soft key forms of data entry, such as are known to those of skill in the relevant arts.

Figure 3:
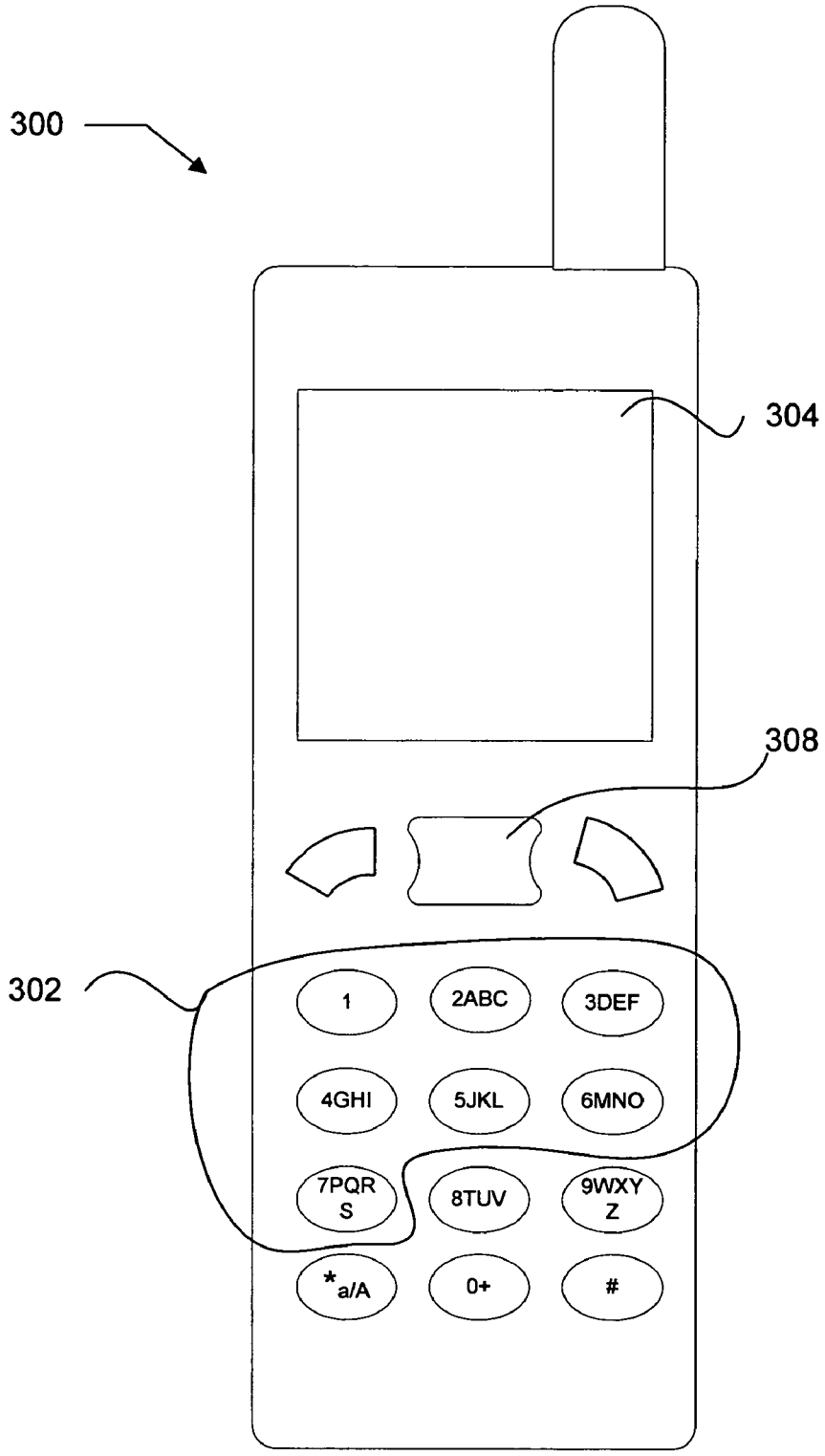
FIG. 3 is a diagram illustrating a keypad and display of a handheld electronic device configured in accordance with one embodiment of the present invention.

FIG. 3 illustrates a handheld wireless telephone configured for composing music in accordance with one embodiment of the present invention. The telephone 300 includes a keypad configuration having at least 10 keys associated with single digit numbers (i.e., 0-9) as is conventionally seen on telephones. Preferably, the pitch of a musical note is determined by selection of a numbered key in the group 302 from 1-7 to represent respectively increasing pitches on a diatonic scale. In other words, depressing the "1" key results in the entry of a first degree of the diatonic scale and a simultaneous display of the number "1" on the display 304 of the handheld 300. Preferably, the numbered key "0" is used to enter a rest, resulting in the display of a "0" on the display 304. The remaining numbered keys (and adjoining keys) e.g., "8" "9", "*" and "#" are preferably used for the various functions and characters necessary to replicate the numeric system on the handheld electronic device's keypad. For example, as detailed further in FIG. 2F, slashes, periods, dashes, and apostrophes are used in lieu of the same or similar symbols from the written numeric notation. These special symbols may be represented directly by one of the unused keys on the handheld or will be accessible from a menu accessed by depressing a key repeatedly or by depressing and holding down a key. For example, in one embodiment, the "*" key may be configured to cycle sequentially through a (,) (') and (.) in response to multiple pressing of the "*" key. For reference purposes, the values indicated in parentheses indicate the values displayed. These values, as described in FIG. 2F, correspond to lower octave, higher octave, and "dotted" note. In similar fashion, the "9" key on the keypad of the handheld device is preferably configured to generate a dash (-) for lengthening the duration of a note, whereas the "8" key is preferably configured to generate a slash (/) for shortening the duration of a note. For another example, the "#" key may be used to access a menu that successively provides at least a sharp (#) and a flat (b) option for appending to an entered note. By using the numeric keys for the notes and symbols that closely replicate the underscores and other symbols of Rousseau's numbered music notation system, keypad entry sequences and displays on wireless phones will be recognized by the many people already familiar with the numbered (numeric) music notation system.

Preferably, the handheld device has one or more joystick type keys 308 indicating an up or down direction. This multifunction key is preferably used in one embodiment for denoting the octave higher and octave lower keys. According to another embodiment, this key may also be used to scroll through menus generated by depressing selected keys. It is to be understood that the foregoing examples are intended to be illustrative and not limiting. The mapping of a particular key to a special character or a menu of special characters may be performed according to techniques known to those of skill in the art and the scope of the invention is intended to embrace all such mappings that are consistent with the guidance provided by the description herein. That is, the mapping of a slash onto a particular key is a function of various design considerations. Whatever the particular mapping of the keys, especially as pertains to the special character keys, the keypad entry sequence preferably offers simplicity in entry and editing, consistent with the details illustrated above. By using the foregoing sequence, particularly by mapping a numbered key to a respective octave scale degree, an easily understandable musical sequence may be entered, displayed, and edited.

In accordance with one embodiment, the number of keys required to enter a plurality of notes, including pitch and duration parameters is minimized. As discussed, handheld devices, particularly wireless telephones provide typically a limited set of keys on the keypad, typically only the keys corresponding to the numbers 0-9, most of these keys having a series of alphabetical characters also associated with them. By selecting a group of keys to represent the seven relative pitches comprising the diatonic scale, and a dedicated one or more of the remaining unused keys on the keypad for providing or adjusting the duration parameters, the number of keypad entry steps is limited or minimized. According to one embodiment, the duration parameters are adjusted using non-alphanumeric keys.

Figure 4A:
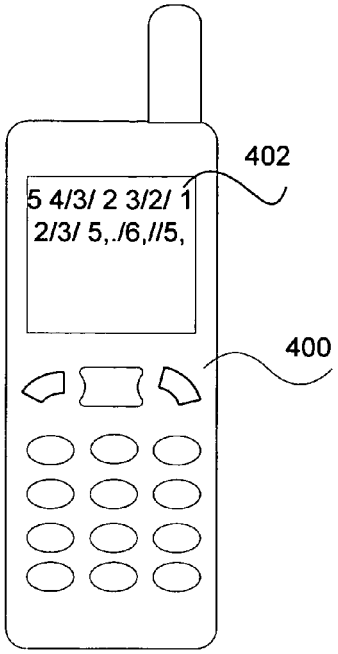
FIG. 4A is a diagram illustrating a keypad and a musical sequence on a display of a handheld electronic device configured in accordance with one embodiment of the present invention.
Figure 4B:
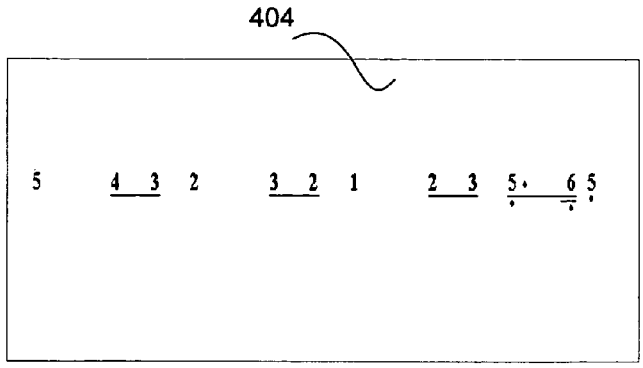
FIG. 4B is a diagram illustrating a graphical numeric notation representation of the musical sequence depicted in the display of FIG. 4A.

As illustrated in FIG. 4A, the displayed sequence 402 generated by the keypad numeric system of various embodiments of the present invention corresponds closely to the graphical format 404 of the written numeric music notation system illustrated in FIG. 4B. It is to be further appreciated that in many cases it is desirable to transmit a text based musical composition to other users, such as in an email message or to be forwarded to electronic devices limited to text based displays. The notation system generated in accordance with the described embodiments provides this capability along with its advantageous presentation in a format understandable by the user. Further, the characters presented in the display 402 correspond closely to the actual numbered keys depressed on the handheld device. For example, to generate the notes depicted by the sequence of numbers 5, 4, 3, 2, 3, 2, etc. shown in display 402, keys having numbers 5, 4, 3, 2, 3, 2, etc. are respectively depressed. In contrast, conventional key press systems now in use show very little correspondence between the keys pressed and the resulting characters displayed.

Figure 4C:
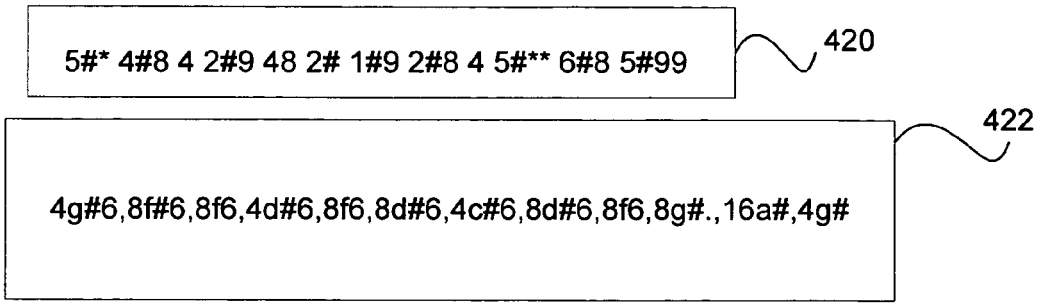
Fig. 4C (Prior Art)
FIG. 4C is a diagram illustrating a conventional keypad entry format and the corresponding display for the same musical sequence entered in FIG. 4A.
Figure 4D:
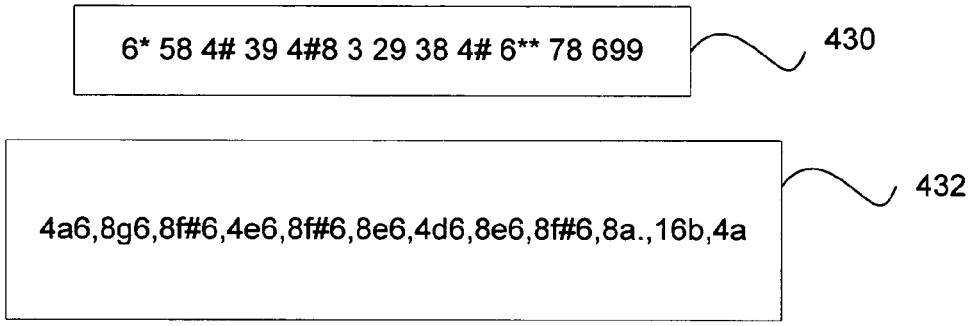
Fig. 4D (Prior Art)
FIG. 4D is a diagram illustrating a conventional keypad entry format and the corresponding display for the musical sequence entered in FIG. 4A.

One conventional ringtone format uses the Ring Tone Text Transfer Language (RTTTL) for storage and display of ringtone files. FIGS. 4C-4D illustrate the difference between key press sequences, display sequences, and key transposition as found in conventional systems. In particular, FIG. 4C illustrates in display 422 the musical composition shown in FIG. 4A in the C# major key on a conventional handheld. The handheld sequence necessary for generating this file and display is depicted in block 420. The same composition converted to the D major key (on a conventional handheld) is shown in FIG. 4D. In particular, the key press sequence shown in block 430 is used by the conventional techniques to generate the displayed sequence shown in display 432. Each of the displays 422 and 432 correspond to a sample of a conventional RTTTL format. In the conventional RTTTL format shown, the notes are separated by commas with the note or event described by duration, pitch name, accidental, and octave. As shown, the conventional techniques require an entirely new sequence to be entered on the keypad. Further, the generated sequences in the displays are not readily recognizable as the same tune as entered on the keypad.

Although the foregoing has described the inventive method as applied to the composition of original musical sequences, the scope of the invention is not so limited. The scope is intended to extend to the display and/or modification of any sequence. For example, the method may be applied to the retrieval from memory storage of a sequence originally composed in the described numeric format for subsequent editing. Alternatively, the sequence may be one sorted in accordance with a standardized format, such as RTTTL, or iMelody, MIDI, or a variety of other formats used by wireless phone vendors. With respect to the standardized formats, preferably, the handheld device is configured with a module for conversion of the standardized formats to the numeric format for subsequent editing.

Figure 5:
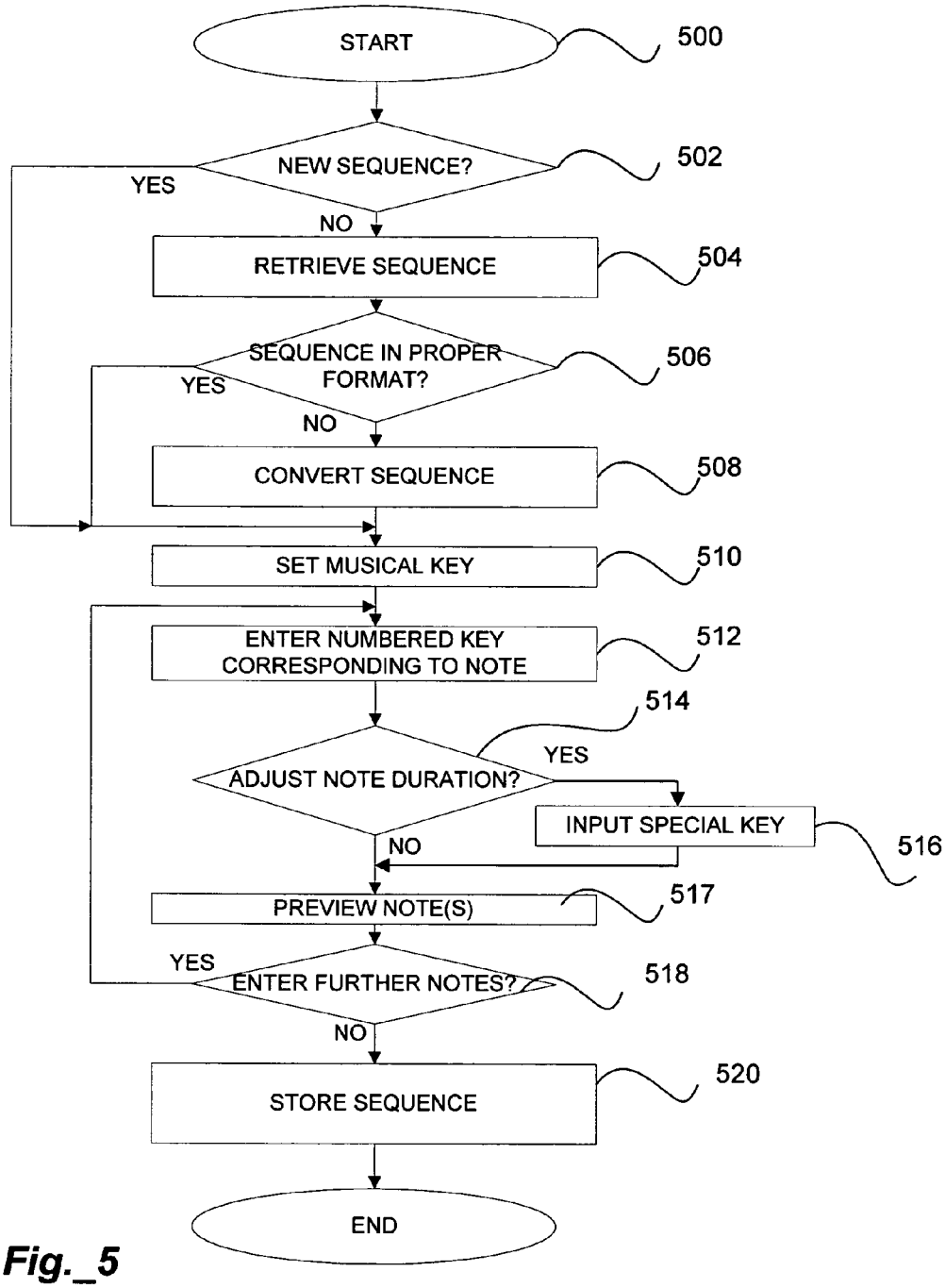
FIG. 5 is a flowchart illustrating a method of entering a musical sequence in accordance with one embodiment of the present invention.

FIG. 5 is a flowchart identifying the steps for composing or editing in accordance with one embodiment of the current invention. The process commences at operation 500. Initially a determination is made in operation 502 as to whether the process involves editing of a sequence or composition of a new musical sequence. For composition of a new sequence the flow proceeds directly to setting the musical key in operation 510. For editing, the sequence is retrieved, preferably from a memory storage location, in operation 504. As to the retrieved sequence, a determination is then made in operation 506 as to whether the retrieved sequence is in the proper format for editing. If the sequence is in the numbered (numeric) format, the process flow again proceeds to operation 510, setting the musical key. If not, then a conversion takes place preferably in a module within the handheld device. Preferably the wireless telephone is equipped with a conversion module capable of converting standardized formats to the numeric format. These standardized formats may include any or all of iMelody, RTTTL, MIDI, and other formats. After conversion in operation 508, the process flow proceeds to operation 510, wherein the sequence of operations is similar whether editing or composing an original musical sequence.

Initially the reference musical key, i.e., the key or tonal center is set in operation 510. This step is important for positioning the sequence in frequency space, i.e., in determining the pitches of the sequence. Preferably this step is performed by using a key entry method to cycle through a menu setting the initial key. More preferably, a default key is used for assignment of the sequence, for example in one embodiment the default key is C Major. Preferably this is set in a header, i.e., a block of data preceding the actual musical sequence.

Next, in operation 512, an individual note is set. This is preferably performed by selecting one of the keys 1-7 on the keypad. As discussed above, an octave change can be performed by entering a special key to enter and display either "X'" or "X", or the other similar variations as described further in FIG. 2C.

After setting the pitch in step 512, the duration of the note is adjusted in operation 514 if necessary from the default value. Typically a default value will be set for a quarter note, thus requiring entry of a second special key (operation 516) when the note duration departs from the default value. Specifics as to key entries for adjusting the duration of the note have been described and illustrated for one embodiment in FIG. 2F.

An optional preview function 517 is preferable incorporated into the sequence at this point. This allows a note or sequence of notes to be played back through the handheld device's speakers or earphones. By previewing the sequence as composed, the listener can detect and correct mistakes in entry of notes. This function may be implemented in a variety of ways, including for example by manually depressing a key on the keypad or automatically.

Next, a determination is made in operation 518 as to whether the sequence is complete. If further notes need to be entered, the process flow proceeds to step 512 for entry of further notes (i.e., numbers) in the musical sequence. If no further notes are required (to be entered or modified), the flow proceeds to operation 520 wherein the sequence is stored. Preferably, the handheld will be further configured to convert the stored numeric sequence to one of a variety of standard configurations as enumerated above (i.e., RTTTL, MIDI, etc.). After storage, the process ends. Preferably, the entered sequence is stored as a MIDI file, then converted back to the numeric format for editing or display. More preferably, the handheld electronic device is configured to perform conversion in a bi-directional manner from any known format for storage for ringtones or other musical sequences.

For editing purposes, preferably the electronic device is configured with a cursor function that permits addition and deletion of characters at the location represented by the cursor on the display of the retrieved (or new) sequence.

By using the key press sequences and display sequences described above, an easy to understand musical notation capable of use on a wide variety of handheld electronic devices is provided. Further, any musical sequence formed using this system can be converted into a different key by a minimal number of keystrokes. That is, by using scale degrees instead of conventional western notes, compositions may easily be transferred in text format, such as by email, yet retain an easily discernible identity when viewed on the display screen of the handheld. This is particularly the case for those already familiar with the numeric musical notation system.

This offers improvement over other languages such as RTTTL and iMelody. Further, this musical notation system allows a composition to be displayed easily on the limited screens of handheld devices. Its intuitive nature enables better comprehension of harmony and melodies. By providing a readily discernible sequence, it augments the editing process, avoiding unnecessary transposition steps.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method of forming a musical sequence on a handheld electronic device having a keypad and a display, the keypad of the handheld device having a plurality of numbered keys mapped to corresponding notes in at least one octave, the method comprising:

composing a sequence of musical notes by selecting more than one numbered key on the keypad of the handheld device, the numbered key based on the mapping of the notes; and displaying a numbered representation of the musical sequence on the display screen of the handheld device, and wherein the musical sequence is transposable to any musical key without changing the numbered representation displayed.

2. The method as recited in claim 1 wherein the mapping is based on a designation of seven numbers on the keypad for the notes of a diatonic scale for an octave and wherein each progressively higher note in the octave corresponds to a progressively higher number.

3. The method as recited in claim 2 wherein the notes in the octave are represented by the numbered keys 1-7.

4. The method as recited in claim 3 wherein keys of the keypad other than the numbered keys 1-7 are used to provide a duration parameter for at least one note of the musical sequence.

5. The method as recited in claim 2 wherein non-alphanumeric keys of the keypad are used to provide a duration parameter for at least one note of the musical sequence.

6. The method as recited in claim 2 wherein a plurality of keys independent of the seven numbers on the keypad are used to adjust a duration parameter from a default value, a first of the plurality causing the duration to increase, a second of the plurality to cause the duration to decrease, and a third of the plurality to cause the duration to increase by 50%.

7. The method as recited in claim 1 wherein the displayed numbered representation comprises for each note a number representing the pitch of the note, and for at least one note, at least one of a slash, dash, or period appended to the number to represent a duration parameter for the note.

8. The method as recited in claim 1 further comprising converting the sequence of notes to a standardized format that is one of a MIDI format and a wireless phone ringtone format.

9. The method as recited in claim 1 wherein the handheld electronic device is a telephone and the sequence of notes is a ringtone.

10. The method as recited in claim 9 further comprising sending the musical sequence in a text message to another individual by using the handheld phone's text messaging capabilities.

11. The method as recited in claim 1 wherein the device is configured to accept entry of an accidental to modify the pitch of a note by the selection of a predetermined one of the keypad keys.

12. The method as recited in claim 1 further comprising:

retrieving a plurality of notes;

displaying the retrieved plurality of notes on the display screen of the handheld device; and accepting a replacement note from the keypad for at least one of the plurality of notes.

13. The method as recited in claim 12 wherein the retrieved plurality of notes is in a standardized format and is downloaded from a computer.

14. A method of forming a musical sequence on a handheld electronic device having a keypad and a display, the keypad of the handheld device having a plurality of numbered keys mapped to corresponding notes in at least one octave, the method comprising:

composing a sequence of musical notes by selecting more than one numbered key on the keypad of the handheld device, the numbered key based on the mapping of the notes; and displaying a numbered representation of the musical sequence on the display screen of the handheld device, and wherein the musical notes are entered by selecting a soft key designated in the display of the device.

15. A handheld electronic device comprising:

a display screen;

a keypad having a plurality of numbered keys mapped to corresponding notes in at least one octave; and a processor configured to:

receive a musical composition formed by entry of a sequence of musical notes by selecting at least one numbered key on the keypad of the handheld device, the numbered key selected based on the mapping of the notes;

identify a designated musical key associated with the musical sequence;

display a numbered representation of the musical sequence on the display screen of the handheld device; and transpose the musical sequence from the designated musical key to any musical key by changing a key reference associated with the musical sequence without changing the numbered representation displayed.

16. The handheld electronic device as recited in claim 15 wherein the mapping is based on a designation of seven numbers on the keypad for the notes of a diatonic scale for an octave and wherein each progressively higher note in the octave corresponds to a progressively higher number.

17. The handheld electronic device as recited in claim 15 wherein the processor is further configured to:

retrieve a plurality of notes from a memory of the handheld device;

display the retrieved sequence on the display screen of the handheld device; and receive a keyed in replacement note for at least one of the plurality of notes retrieved from memory, wherein the replacement notes are keyed in by selecting a numbered key corresponding to a numbered designation for the corresponding note.

18. A method of forming a musical sequence on a handheld wireless telephone having a keypad and a display, the keypad of the wireless telephone having a plurality of numbered keys mapped to corresponding notes in at least one octave, each progressively higher note in the octave corresponding to a progressively higher number, the method comprising:

receiving a designated musical key;

entering a sequence of musical notes by depressing a plurality of numbered keys on the keypad of the wireless telephone, the numbered key selected for each note in the sequence based on the mapping of the notes; and displaying a numbered representation of the musical sequence on the display screen of the wireless telephone, wherein each number in the numbered representation corresponds to the mapping of the notes; and wherein the musical sequence is transposable to any musical key without changing the numbered representation displayed; and wherein the musical sequence may be edited by using the keypad to change the numbered representation of the musical sequence.

19. A handheld electronic device comprising:

a display screen;

a keypad having a plurality of numbered keys mapped to corresponding notes in at least one octave; and a processor configured to:

retrieve a musical sequence comprising a plurality of notes from a memory of the handheld device;

determine whether the musical sequence is in a numbered representation;

convert the musical sequence to the numbered representation if the determination is negative;

generate a display comprising the numbered representation of the musical sequence on the display screen of the handheld device; and edit at least one of the notes by using the keypad to change the numbered representation of the musical sequence by receiving a keyed in replacement note for at least one of the plurality of notes retrieved from memory, wherein the replacement notes are keyed in by selecting a numbered key corresponding to a numbered designation for the corresponding note.

20. The device as recited in claim 19 wherein the device is a portable telephone.

* * * * *